US009144731B1

(12) United States Patent
Brooks et al.

(10) Patent No.: US 9,144,731 B1
(45) Date of Patent: Sep. 29, 2015

(54) SLIDING PLASTIC SLEEVE FOR POOL CUE

(71) Applicants: Jeremy G. Brooks, Lake Worth, FL (US); Keith A. Colombo, Loxahatchee, FL (US)

(72) Inventors: Jeremy G. Brooks, Lake Worth, FL (US); Keith A. Colombo, Loxahatchee, FL (US)

(73) Assignee: B&C BILLIARD PRODUCTS, INC., Loxahatchee, FL (US)

( * ) Notice: Subject to any disclaimer, the term of this patent is extended or adjusted under 35 U.S.C. 154(b) by 58 days.

(21) Appl. No.: 14/095,339

(22) Filed: Dec. 3, 2013

Related U.S. Application Data

(60) Provisional application No. 61/841,978, filed on Jul. 2, 2013, provisional application No. 61/841,986, filed on Jul. 2, 2013.

(51) Int. Cl.
*A63D 15/00* (2006.01)
*A63D 15/10* (2006.01)

(52) U.S. Cl.
CPC ..... *A63D 15/105* (2013.01)

(58) Field of Classification Search
CPC ..... A63D 15/105; A63D 15/08; A63D 15/00
USPC ..... 473/1, 2, 42, 43, 46
See application file for complete search history.

(56) References Cited

U.S. PATENT DOCUMENTS

| | | | | |
|---|---|---|---|---|
| 529,731 | A | 11/1894 | Gschwendtner | |
| 870,491 | A | 11/1907 | Gallaghan | |
| 1,092,189 | A * | 4/1914 | Varian | 473/43 |
| 1,159,133 | A * | 11/1915 | Thomson | 473/46 |
| 2,931,649 | A | 4/1960 | Furda | |
| 3,416,794 | A | 12/1968 | Ciano | |
| 3,534,949 | A | 10/1970 | Elswick | |
| 4,147,346 | A | 4/1979 | Giannetti | |
| 5,238,457 | A | 8/1993 | Triplett | |
| 5,290,030 | A | 3/1994 | Medbury | |
| 5,478,282 | A | 12/1995 | Possum et al. | |
| 6,042,481 | A | 3/2000 | Walker et al. | |
| 6,066,051 | A | 5/2000 | Liu et al. | |
| 6,113,501 | A * | 9/2000 | Richards | 473/46 |
| 7,169,055 | B2 | 1/2007 | Mekosh | |
| 7,611,416 | B1 * | 11/2009 | Mattina et al. | 473/2 |

* cited by examiner

*Primary Examiner* — Mitra Aryanpour
(74) *Attorney, Agent, or Firm* — Mark D. Bowen; Malin Haley DiMaggio & Bowen, P.A.

(57) ABSTRACT

A friction-reducing sleeve that may be easily installed on a pool cue to provide the user with a comfortable ergonomic grip while providing low static and dynamic coefficients of friction preferably comprises an open ended, generally tubular seamless sleeve that may be fabricated with one or more layers of woven, natural and/or synthetic, material. The cue sleeve is preferably generally cylindrical, but capable of radial self-adjustment, to maintain a conforming fit that results in constant contact between the inner surface of the sleeve and the tapered outer surface of the cue. The sleeve outer surface is characterized as having a high static coefficient of friction to ensure a slip-free grip.

5 Claims, 6 Drawing Sheets

SLIDING PLASTIC SLEEVE FOR POOL CUE

CROSS REFERENCE TO RELATED APPLICATIONS

This application claims the benefit of provisional U.S. Patent Application No. 61/841,978, filed on Jul. 2, 2013, and provisional U.S. Patent Application No. 61/841,986, filed on Jul. 2, 2013.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention generally relates to cue sports, and more particularly to a sliding sleeve accessory for use with a pool or billiard to make use of the cue more convenient and precise when executing shots.

2. Description of Related Art

Billiard games are mostly played with a stick known as a cue. The cue typically comprises a one piece tapered stick or a two piece stick wherein the pieces are adapted to be coupled together in the middle, such as by threaded connection. The cue typically includes a butt end, a tapered shaft projecting from the butt end and terminating at a ferrule upon which a rounded tip is affixed for making contact with the balls. A billiard player typically grasps the butt end of the cue with one hand (e.g. with the right hand, for right handed players) and supports the cue shaft by making a bridge with his/her other hand. A bridge is formed by placing a hand on the table and spreading the fingers apart such that the cue can slide between the "V" that is formed between the thumb and index finger, or alternately between index and middle finger knuckles. The billiard player then executes a shot by moving the cue longitudinally relative to the bridge hand with a short jab or thrusting motion. The smooth movement of the cue across the supporting surfaces of the player's hand is critical in executing precise shots.

The skin of the player's hand, however, is not an ideal sliding surface for a cue. For example, perspiration can cause the player to experience difficulty executing a shot by affecting the ability of the cue to glide smoothly over the skin. In an effort to address this problem, billiard players commonly apply a dry lubricating powder, such as chalk, to their cue support hand. The powder, however, must be repeatedly reapplied and is known to get on the player's clothing, the felt table covering, furniture etc.

Accordingly, various devices and methods have been developed in an attempt to overcome these limitations and disadvantages. The background art reveals a number of attempts to provide devices that reduce the friction between the cue and the player's hand. For example, U.S. Pat. No. 529,731, issued to Gschwendtner, discloses attaching a loose, but closely fitting sleeve to the guiding end of the cue which is laid on the guiding hand whereby the guiding end of the cue does not come in direct contact with the hand. U.S. Pat. No. 870,491, issued to Callaghan, discloses tubular cue sleeve through which a cue passes. The cue sleeve includes external structure to aid in the accurate positioning of the cue-holding hand. U.S. Pat. No. 2,931,649, issued to Furda, discloses a cue supporting device that allows the cue to be used by a single hand. U.S. Pat. No. 3,416,794, issued to Ciano, discloses a bridge-aid device for cues. U.S. Pat. No. 3,534,959, issued to Elswick, discloses a cue stick having a self-contained hollow guide member with a flanged sleeve. A flanged shaft portion of the cue stick is slidable within the flanged sleeve. U.S. Pat. No. 4,147,346, issued to Giannetti, discloses a guide adapted to be hand-held and adapted to receive the shaft of a cue stick so the cue stick may glide easily. The guide includes a depending support that forms a handle that supports the cue stick above the surface of the pool table. U.S. Pat. No. 5,238,457, issued to Triplett, discloses a sliding cue holder device having an upright post with a semi-spherical drum member fixed to the bottom post that provides a rounded bottom surface for engaging the playing surface of the pool table. U.S. Pat. No. 5,290,030, issued to Medbury, discloses a cue having a bridge sleeve through which the cue can slide. U.S. Pat. No. 5,478,282, issued to Possum et al., discloses pool cue having a freely slidable tubular sleeve disposed thereon. U.S. Pat. No. 6,042,481, issued to Walker et al., discloses a braided friction-reducing sleeve for a billiard cue shaft. U.S. Pat. No. 6,066,051, issued to Liu et al., discloses a pool cue having a sliding bridge sleeve with cleaning wipers. U.S. Pat. No. 7,169,055, issued to Mekosh, discloses a pool cue with a slidable sleeve and o-rings that prevent the sleeve from falling off the cue.

The various devices disclosed in the background art are burdened by a number of disadvantages and shortcomings that have limited acceptance and use of such devices in the field of cue sports. A number of the devices are bulky and overly complex and have thus not realized widespread acceptance. In addition, the sleeve-type devices generally fail to address the competing demands for an inner surface providing a low coefficient of friction to promote smooth slidable engagement and an outer surface that provides a comfortable fit with the player's bridge hand.

Accordingly, there exists a need in the art for a pool cue adapted with a slidable sleeve that provides a smooth stroke while mating comfortably, yet securely, with the user's bridge hand.

BRIEF SUMMARY OF THE INVENTION

The present invention overcomes the limitations and disadvantages present in the art by providing a friction-reducing cue sleeve that may be easily installed on a pool cue to provide the user with a comfortable ergonomic grip while providing low static and dynamic coefficients of friction. Such an improved cue sleeve preferably comprises an open ended, generally tubular sleeve that is capable of radial self-adjustment, to maintain a fit that provides constant contact with the tapered outer surface of the cue. The sleeve outer surface is preferably characterized as having a high static coefficient of friction to ensure a slip-free grip, whereas the sleeve inner surface is preferably characterized as having a low coefficient of friction to ensure that the device slides smoothly along the pool cue.

Accordingly, it is an object of the present invention to provide advancements in the art of cue sports.

It is another object of the present invention to improve cue handling by providing a sliding cue sleeve having low coefficients of static and dynamic friction.

Yet another object of the present invention is to provide such a sleeve that has an outer surface having a high coefficient of static friction.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, when a number or a range is recited, ordinary skill in the art understand it intends to encompass an appropriate, reasonable range for the particular field related to the invention.

With reference now to the drawings, FIGS. 1-13 depict preferred and alternate embodiments of friction-reducing sliding sleeve apparatus in accordance with the present invention. FIGS. 1-7 depict a preferred embodiment of a sliding sleeve accessory, generally referenced as 100, for a pool cue.

Figure 1:
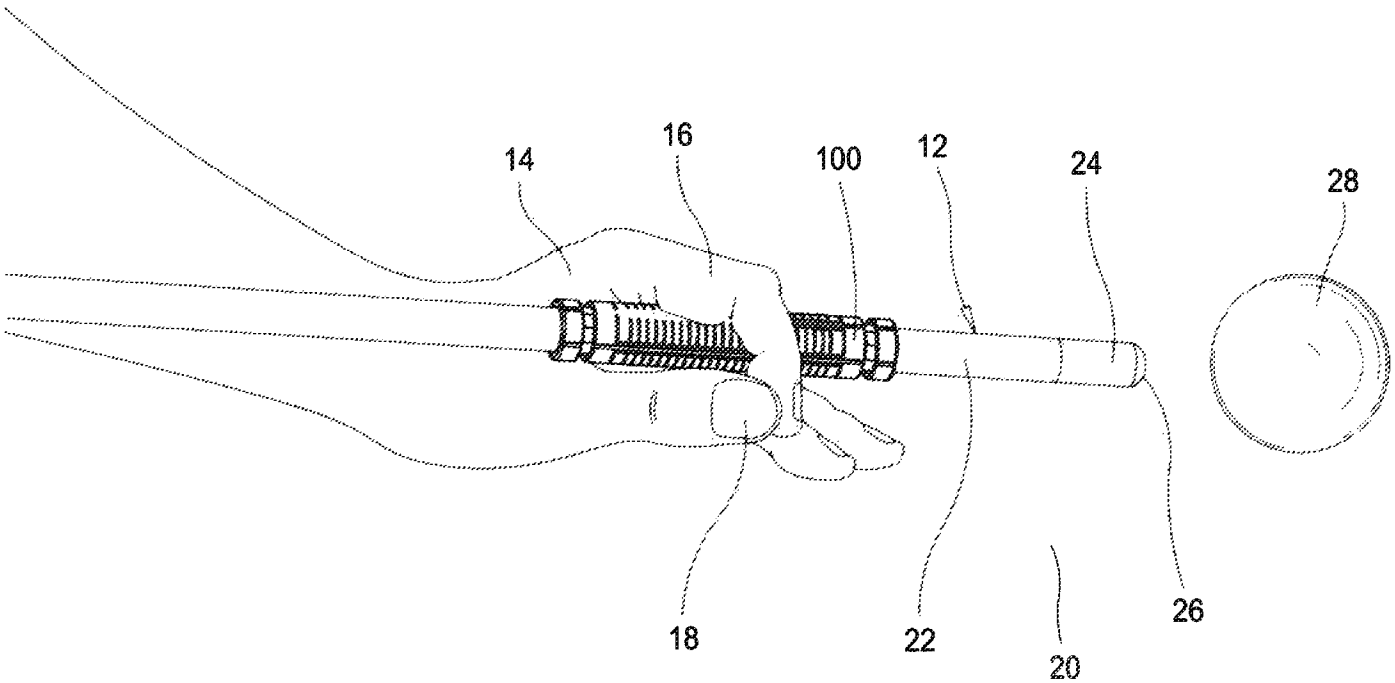
FIG. 1 is a perspective view of a pool cue adapted with a bridge-hand friction-reducing sliding sleeve in accordance with a preferred embodiment of the present invention.

FIG. 1 illustrates the sliding sleeve 100 in accordance with the preferred embodiment operatively installed on a pool cue 12. Sleeve 100 and cue 12 are held in the player's guide or bridge hand 14 and secured by the player's forefinger 16 and thumb 18. The player executes a shot by placing his guide hand on the table 20 and moving the cue 12 in sliding engagement with sleeve 100. As should be apparent, sleeve 100 remains generally stationary relative to the player's guide hand 14. A typical cue 12 includes a butt end (not shown) a tapered shaft 22 terminating in an end portion 24 terminating in a felt tip 26 for striking a ball 28. The cue, and particularly, the portion likely to contact the player's guide hand has typically been finely sanded (e.g. by use of 1500 grit sand paper) to form a very smooth surface. Cue sleeve 100 is preferably generally cylindrical, but capable of radial self-adjustment, to maintain a fit that provides constant contact between the inner surface of the sleeve and the tapered outer surface of the cue as the varying diameter cue slides back and forth through sleeve 100.

Figure 2:
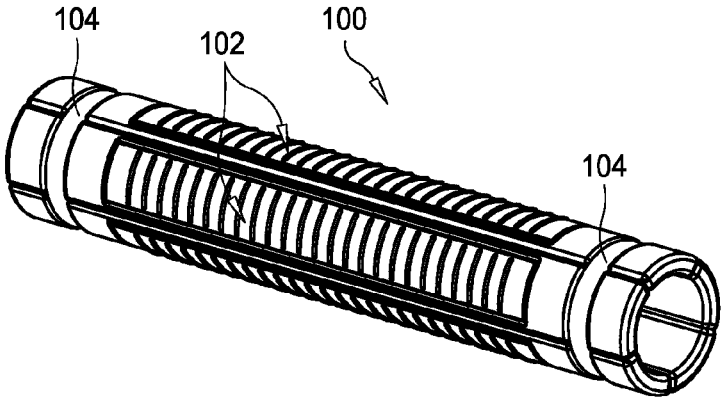
FIG. 2 is a perspective view of the sleeve.

A significant aspect of the present invention involves providing a friction-reducing sleeve that may be easily installed on a pool cue to provide the user with a comfortable ergonomic grip while providing low static and dynamic coefficients of friction. FIGS. 2-7 depict more detailed views of a sliding pool cue sleeve 100 in accordance with the preferred embodiment. Turning first to FIG. 2, there is depicted a perspective view of the preferred embodiment of the friction-reducing sleeve 100 comprising an open ended, generally tubular sleeve sized for insertedly receiving the tapered portion of a cue therein in slidable engagement therewith. Sleeve 100 is preferably fabricated from a plurality of elongate segments, each referenced as 102, and each having a length of approximately between 4.0 to 6.0 inches. Segments 102 are preferably maintained in substantially adjacent, yet radially expandable positions, by resilient bands 104 disposed in proximity to opposing ends thereof. Each segment 102 defines first and second opposing end portions, each end portion defining an undercut notch that functions to receive resilient bands 104 securely disposed whereby a plurality (preferably five) of segments 102 may be maintained in an open-ended, radially expandable, tubular configuration as seen in FIG. 2. Providing undercut notches 106 allows for replacement of bands 104, either upon breakage, or for adjustment of elasticity (e.g. to provide a greater or lesser degree of elastic tension/compression). When operatively configured, segments 102 form a sleeve having an inner diameter sized to fit snugly over the tapered portion of a pool cue having an outer diameter of approximately between 11.0 mm-20.0 mm. Furthermore, resilient bands 104 function to maintain the segments 102 in constant contact with the pool cue by allowing for independent radial expansion and contraction of each sleeve end as the sleeve slides back and forth.

Each sleeve segment 102 has an inner surface 110 characterized as having a low coefficient of static and dynamic friction. The desired coefficients of friction are below 0.5, and are preferably below 0.1. Inner surface 110 may be formed by the material forming segment 102, or may be formed by application of a low friction coating to the inner surface thereof. Suitable low fiction coatings include self-lubricating materials, such as TEFLON®, Nylon, or any other suitable low friction material or coating. TEFLON® is a registered trademark of E.I. DuPont De Nemours and Company for synthetic resinous fluorine-containing polymers.

Figure 3:
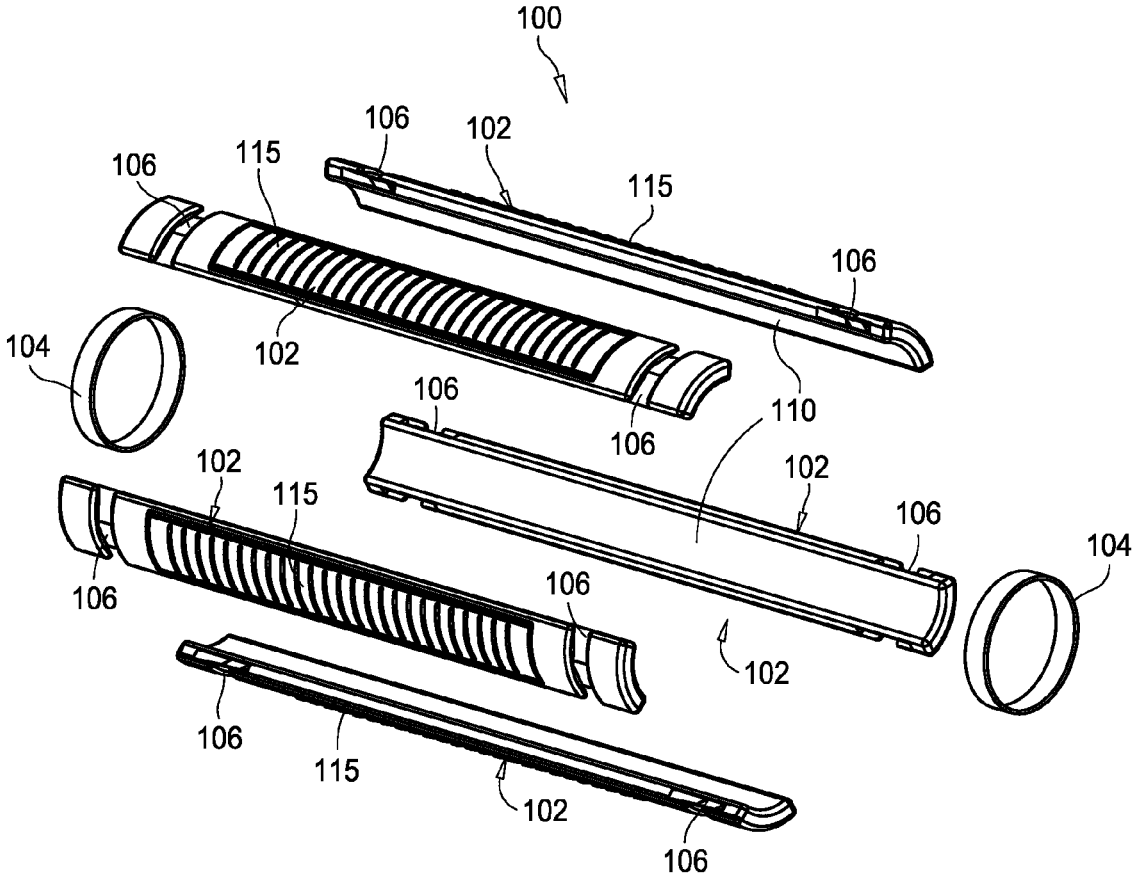
FIG. 3 is an exploded view thereof.
Figure 4:
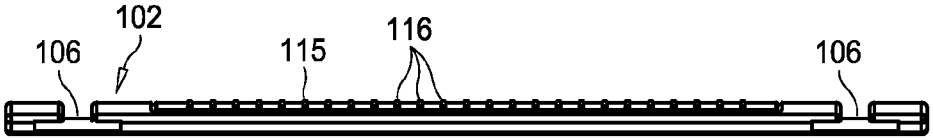
FIG. 4 is a side view of one of plurality of identical components for forming the sliding sleeve.
Figure 5:
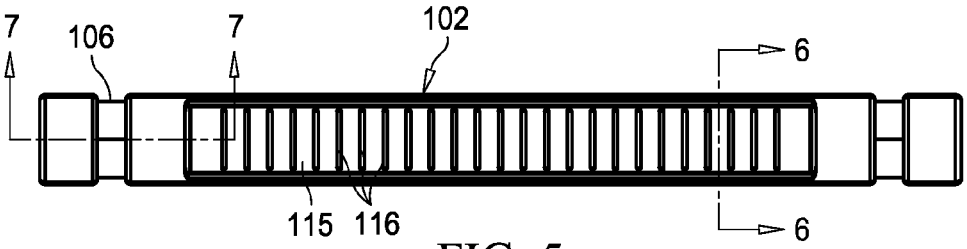
FIG. 5 is a plan view thereof.
Figure 6:
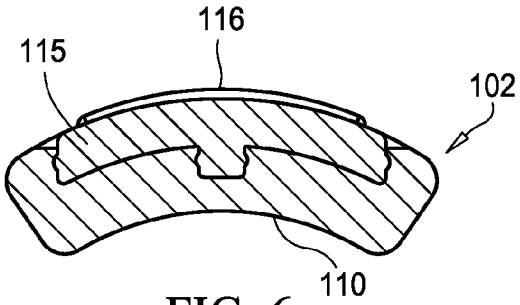
FIG. 6 is a sectional view taken along line 6-6 in FIG. 5.
Figure 7:
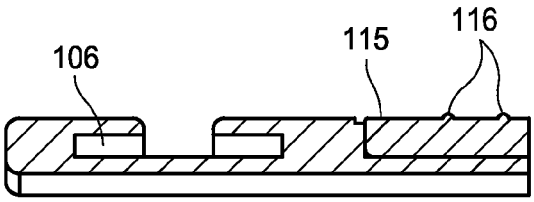
FIG. 7 is a sectional view taken along line 7-7 in FIG. 5.

As best depicted in FIGS. 4 and 5, each sleeve segment 102 further includes an outer surface having gripping layer or insert, generally referenced as 115, that has at least a portion thereof characterized as having a generally high coefficient of static friction thereby allowing the user to maintain a comfortable, secure, slip-free grip. In a preferred embodiment segment 102 defines a recess for receiving a grip insert 115 as best seen in FIGS. 4-7. The entire outer surface 115 may comprise natural or synthetic (e.g. Neoprene) rubber material, polymeric material (e.g. polystyrene, polyethylene, etc.), or any other suitable material. Grip insert 115 may further include embossed grip enhancing elements 116 which project from grip insert 115. In the preferred embodiment depicted in FIGS. 2-7, grip enhancing elements 116 are generally transversely disposed relative to the longitudinal axis of the sleeve, however any suitable structure is considered within the scope of the present invention. Further, grip elements 106 may be formed to have an elongate, generally rectangular cross-section as illustrated in FIG. 3, or may be formed with a semicircular cross-section, or truncated conical cross-section, or any other suitable cross-sectional shape.

Figure 8:
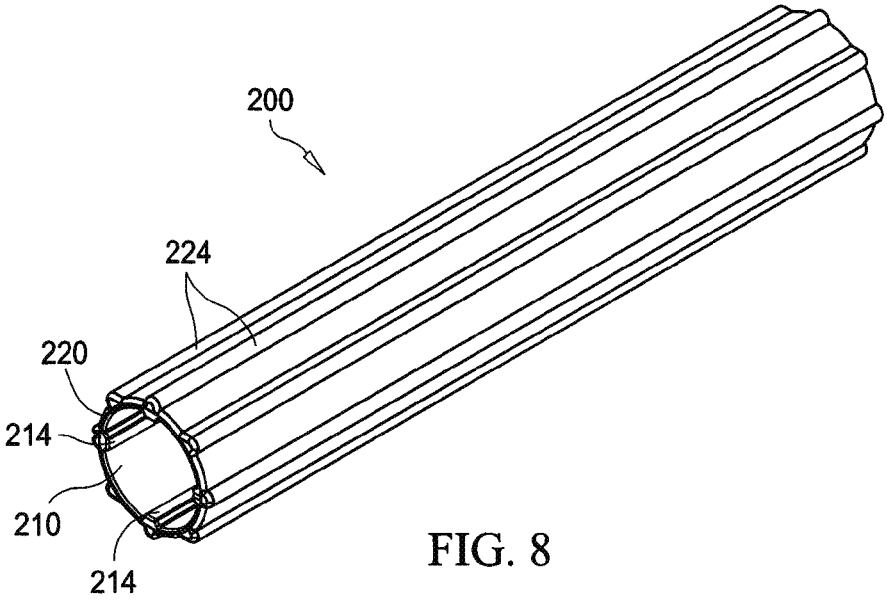
FIG. 8 is a perspective view of an alternate embodiment sliding sleeve in accordance with the present invention.
Figure 9:
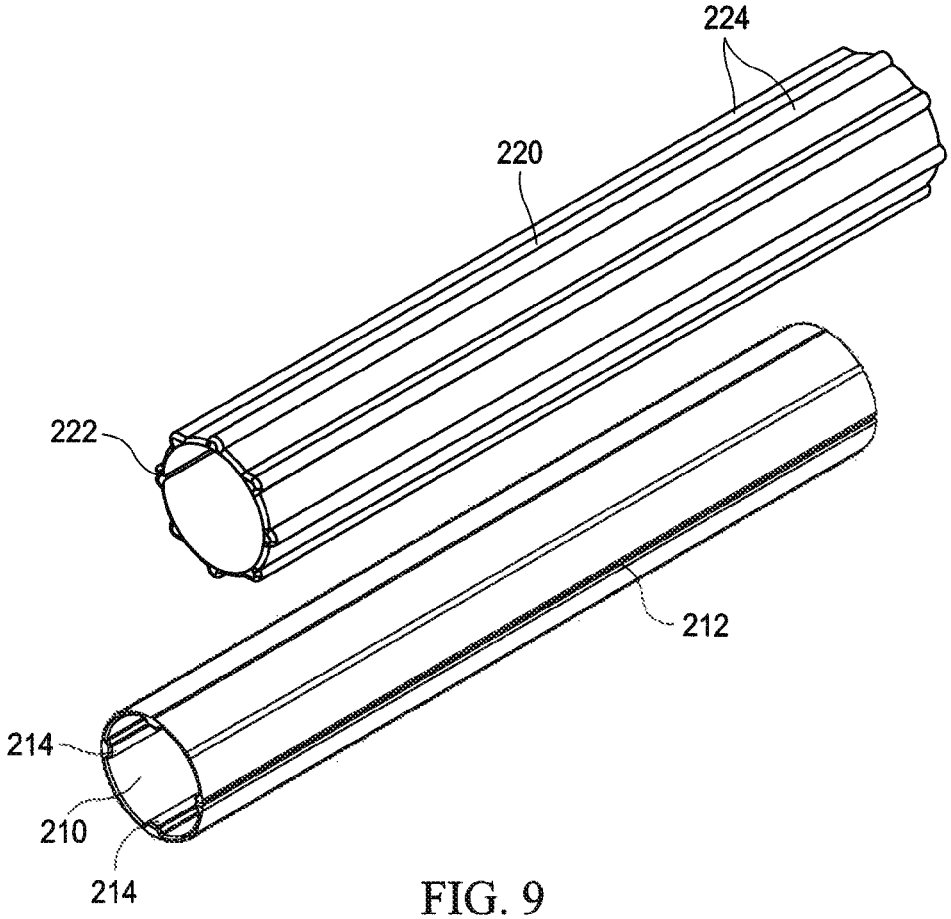
FIG. 9 is an exploded perspective view thereof.
Figure 10:
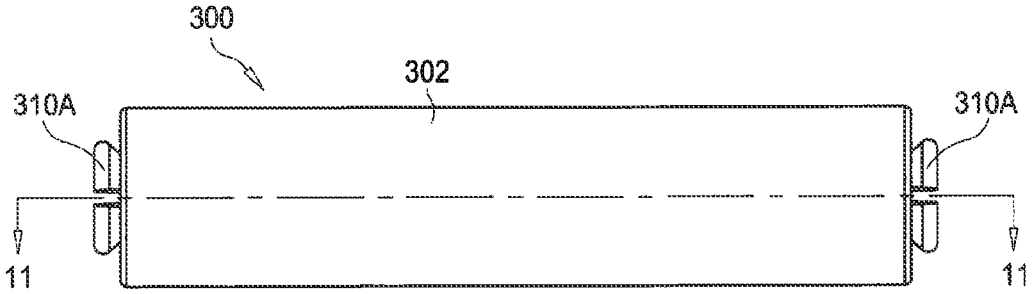
FIG. 10 is a side view of another alternate embodiment sliding sleeve in accordance with the present invention.

Turning now to FIGS. 8 and 9, there is depicted an alternate embodiment friction-reducing sleeve 200. FIG. 8 depicts a perspective view of sleeve 200 and FIG. 9 depicts an exploded perspective view thereof. Sleeve 200 comprises an open ended assembly including concentrically disposed inner and outer tubular members, referenced as 210 and 220 respectively. Inner tubular member 210 includes a longitudinal slit 212, and outer tubular member 220 includes a longitudinal slit 222, each of which slits extend completely from end-to-end thereby allowing for radial expansion of the tubular members as the sleeve slides along a tapered pool cue. When operatively assembled, longitudinal slit 212 of tubular member 210 is preferably diametrically opposed relative to longitudinal slit 222 of tubular member 220. Inner member 210 further defines a plurality of radially inwardly projecting longitudinal ridges or rails 214 that function as sliding surfaces to reduce the surface area in contact with the pool cue so as to minimize sliding friction. Outer tubular member 220 has an outer surface defining radially outwardly projecting longitudinal ridges 224 that function as grip enhancing structures to provide a comfortable and secure grip. Sleeve 30 is preferably approximately 2.0-4.0 inches in length, however any suitable length is considered within the scope of the present invention.

Figure 11:
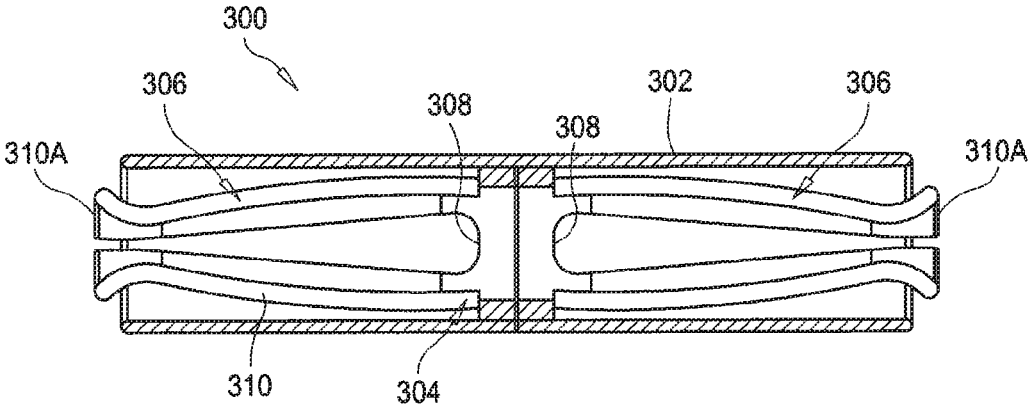
FIG. 11 is a sectional view thereof taken along line 11-11 of FIG. 10.
Figure 12:
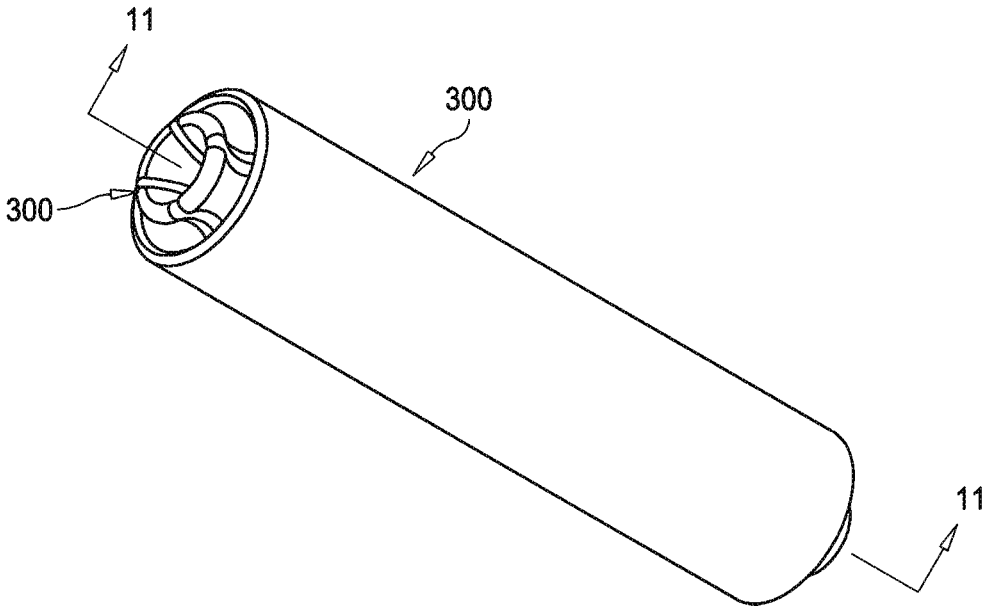
FIG. 12 is a perspective view thereof.
Figure 13:
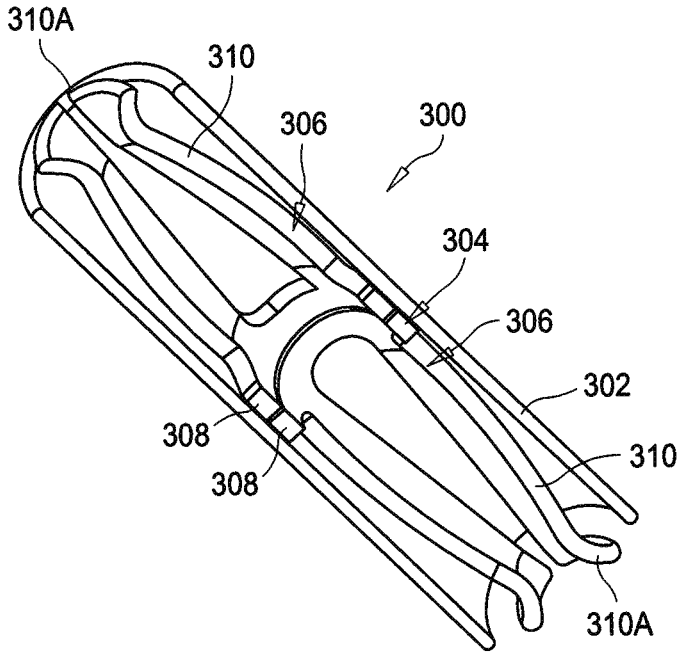
FIG. 13 is a sectional perspective view thereof.

FIGS. 10-13 a second alternate embodiment of a friction reducing cue sleeve, generally referenced as 300, in accordance with the present invention. Sleeve 300 includes a generally tubular outer member 302 and a cue engaging insert assembly, generally referenced as 304, disposed within outer member 302. Outer member 302 preferably comprises a generally tubular, open-ended structure and may be fabricated from a resilient material or a rigid material. In a preferred embodiment outer member 302 may include an outer surface characterized as having a high coefficient of static friction in accordance with the teachings herein. Cue engaging insert assembly 304 comprises first and second insert members, referenced as 306, preferably disposed in abutting opposing end-to-end relation as best illustrated in FIG. 11. In an alternate embodiment, the cue engaging insert assembly 304 may be fabricated as a single piece. Each insert member 306 includes an annular end 308, preferably centrally disposed relative to the length of outer member 302, and having an outer diameter sized for mating inserted engagement with the inner diameter of outer member 302, and an inner diameter sufficient to receive a portion of the pool cue therethrough. Each insert member 306 further includes a plurality of longitudinally projecting resilient arms 310 adapted for slidably engaging the pool cue. As should be apparent, the resilient nature of arms 310 allows the arms to move to conform to the tapered outer pool cue surface as the cue slides relative to the sleeve thereby maintaining sliding engagement. Each arm 310 preferably includes a radially outwardly flared end portion 310A. In a preferred embodiment each insert 306 includes four (4) resilient arms 310.

As should now be apparent, the present invention functions by simply slipping the friction-reducing sleeve 100 (or any of the other alternate embodiments, 200 and/or 300) onto the cue stick 12 into an operative position as illustrated in FIG. 1. The user grasps the sleeve with his guide hand and executes a shot by sliding the cue back and forth through the 100 whereby the sleeve automatically radially expands and contracts in conforming engagement with the outer surface of the cue stick, and whereby inner surface provides smooth almost friction free sliding.

The foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention. The instant invention has been shown and described herein in what is considered to be the most practical and preferred embodiment. It is recognized, however, that departures may be made therefrom within the scope of the invention and that obvious modifications will occur to a person skilled in the art.

We claim:

1. A sliding sleeve for use with a pool cue having a butt end, a tapered shaft extending from the butt end to a front end portion terminating at a tip, said sliding sleeve comprising:

a plurality of segments forming a tube, said tube defining opposing open ends, each of said segments having a radially inner surface and a radially outer surface;

a plurality of resilient bands disposed in surrounding relation with said tube to maintain said segments in substantially adjacent, radially expandable relation whereby the radially inner surface of each of said segments is maintained in contact with the pool cue.

2. The sliding sleeve according to claim 1, wherein each radially inner surface is characterized as having a low coefficient of friction.

3. The sliding sleeve according to claim 1, wherein each radially outer surface has at least a portion thereof characterized as having a high coefficient of friction.

4. The sliding sleeve according to claim 3, wherein each segment defines a recess with an insert received within said recess, said insert characterized as being resilient and including embossed grip elements.

5. The sliding sleeve according to claim 1, wherein each segment has opposing first and second end portions, each end portion defining a notch, a first resilient band received in the notches defined in corresponding first end portions of said segment members, and a second resilient band received in the notches defined in corresponding second end portions of said segment members whereby said resilient bands allow for radial expansion and contraction of said sleeve while sliding along the tapered pool cue.

* * * * *